US009919773B2

(12) United States Patent
Gelin et al.

(10) Patent No.: US 9,919,773 B2
(45) Date of Patent: Mar. 20, 2018

(54) SYSTEM FOR FLUID TRANSFER BETWEEN A SHIP AND A FACILITY, SUCH AS A CLIENT SHIP

(71) Applicant: GAZTRANSPORT ET TECHNIGAZ, Saint Remy les Chevreuse (FR)

(72) Inventors: Guillaume Gelin, Orsay (FR); Bertrand Bugnicourt, Dourdan (FR); Nicolas Vilmen, Massy (FR); Arnaud Landure, Guyancourt (FR); Benjamin Charpentier, Paris (FR)

(73) Assignee: Gaztransport Et Technigaz, Saint Remy les Chevreuse (FR)

( * ) Notice: Subject to any disclaimer, the term of this patent is extended or adjusted under 35 U.S.C. 154(b) by 25 days.

(21) Appl. No.: 15/030,256

(22) PCT Filed: Oct. 14, 2014

(86) PCT No.: PCT/FR2014/052608

§ 371 (c)(1),
(2) Date: Apr. 18, 2016

(87) PCT Pub. No.: WO2015/063385

PCT Pub. Date: May 7, 2015

(65) Prior Publication Data

US 2016/0251062 A1 Sep. 1, 2016

(30) Foreign Application Priority Data

Oct. 31, 2013 (FR) ..... 13 60692

(51) Int. Cl.
*B63B 27/25* (2006.01)
*B63B 27/34* (2006.01)

(52) U.S. Cl.
CPC ..... *B63B 27/25* (2013.01); *B63B 27/34* (2013.01)

(58) Field of Classification Search
CPC ..... F17C 5/06; F17C 2270/0105; F17C 2265/07; F17C 2265/061;
(Continued)

(56) References Cited

U.S. PATENT DOCUMENTS 3,228,421 A 1/1966 Sheiry
3,984,059 A * 10/1976 Davies ..... B63B 27/24 138/114
(Continued)

FOREIGN PATENT DOCUMENTS

CN 101863308 A 10/2010
GB 2177671 A 1/1987
WO 0134460 A1 5/2001

*Primary Examiner* — Timothy L Maust
*Assistant Examiner* — Andrew Schmid
(74) *Attorney, Agent, or Firm* — Notaro, Michalos & Zaccaria P.C.

(57) ABSTRACT

A system for transfer of a fluid between a ship and a facility having a mast, at least one fluid transfer line which extends along the mast, and at least one duct suspended on the distal end of the mast, which is firstly connected to the fluid transfer line, and secondly equipped with a connection element which is designed to cooperate with a manifold of the facility. The duct has a first, rigid portion and a second, flexible portion, and a rigidification element which is fitted such as to be mobile along the duct between a position for rigidification of the flexible portion and a position of release.

16 Claims, 7 Drawing Sheets

(58) Field of Classification Search
CPC ..... F17C 2250/0408; F17C 2250/032; F17C 2227/04; F17C 2227/032; F17C 2227/048; F17C 2227/0388; F17C 2227/0318; F17C 2227/0185; F17C 2227/0164; D17C 2260/056; D17C 2260/042; D17C 2260/025; B63B 27/25; B63B 27/34
See application file for complete search history.

(56) References Cited

U.S. PATENT DOCUMENTS

| | | | | | |
|---|---|---|---|---|---|
| 4,418,718 | A * | 12/1983 | Fusy | B63B 27/24 | 137/615 |
| 6,659,703 | B1 * | 12/2003 | Kirkley | B63B 27/10 | 414/138.2 |
| 8,308,517 | B1 * | 11/2012 | Shivers, III | B63B 21/50 | 114/230.14 |
| 8,490,563 | B1 | 7/2013 | Shivers, III | | |
| 9,346,521 | B2 * | 5/2016 | Lachaud | B63B 23/40 | |
| 2009/0165874 | A1 * | 7/2009 | Pollack | B63B 27/24 | 137/615 |
| 2009/0205343 | A1 * | 8/2009 | Dupont | B63B 27/24 | 62/50.7 |

* cited by examiner

SYSTEM FOR FLUID TRANSFER BETWEEN A SHIP AND A FACILITY, SUCH AS A CLIENT SHIP

TECHNICAL FIELD

The invention relates to the field of fluid transfer, and more particularly relates to the transfer of liquid natural gas between a ship and a facility, such as a client ship.

TECHNOLOGICAL BACKGROUND

In the prior art, systems are known which make it possible to transfer liquid natural gas, at sea, between two ships. By way of example, document WO0134460 discloses a system which makes it possible to transfer liquid natural gas between a liquid natural gas production ship and a liquid natural gas transport ship. The transfer system comprises three parallel flexible ducts, two of which make it possible to transfer the liquid natural gas from the production ship to the transport ship, whereas the third duct makes it possible to transfer gas from the transport ship to the production ship in order to balance the pressures in the gaseous headspaces of the tanks of the two ships, and thus to prevent the pressure inside the tank of the production ship from dropping. The three flexible ducts are suspended on a mast which is fitted such as to be mobile on the deck of the production ship, and have a free end equipped with an element for connection to a collector, commonly known as a manifold, of the liquid natural gas transport ship.

A transfer system of this type does not give entire satisfaction. In fact, when the sea is rough, the relative movements between the two ships make the movements of the flexible ducts random, and makes them particularly complicated to handle. The maneuvering difficulties thus make the operations of connection of the flexible ducts to the manifold of the transport ship lengthy to carry out and insecure.

SUMMARY

The concept on which the invention is based is to propose a system for transfer of a fluid between a ship and a facility, which makes it possible to establish the connection between the ship and the facility simply, rapidly and securely.

According to one embodiment, the invention provides a system for transfer of a fluid between a ship and a facility comprising:

- a mast comprising a proximal end which is designed to be secured on a platform of the supplier ship, and a distal end;
- at least one fluid transfer line which extends along the mast; and
- at least one duct suspended on the distal end of the mast, which is firstly connected to the fluid transfer line, and secondly equipped with a connection element which is designed to cooperate with a manifold of the facility;

wherein the duct comprises:

- a first, rigid portion and a second, flexible portion, which extend successively from the fluid transfer line to the connection element; and
- a rigidification element which is fitted such as to be mobile along the duct, between an elongate position for rigidification of the flexible portion, in which the rigidification element extends along the flexible portion in order to align the flexible portion in the extension of the rigid portion, and a retracted position of release, in which the rigidification element extends along the rigid portion, in order to permit flexion of the flexible portion.

According to one embodiment, the rigidification element comprises a support which can slide relative to the flexible portion, along the flexible portion, the support cooperating with a distal end of the flexible portion in the elongate position of the rigidification element, in order to align the flexible portion in the extension of the rigid portion, and the support cooperating with an area of the duct, situated between the distal area of the flexible portion and the distal end of the mast, in the retracted position of release of the rigidification element, such as to release said support along a free length of the flexible portion, in order to permit flexion of the flexible portion along the free length.

Thus, firstly, when the rigidification element is in the elongate rigidification position, the flexible portion is maintained in the alignment of the rigid portion, which facilitates its handling, and secondly, when the rigidification element is in the position of release, the suspended duct has a certain flexibility in order to permit relative movement between the ship and the facility.

Thus, a transfer system of this type makes it possible to establish the connection between two ships rapidly and securely. A transfer system of this type can also be used to supply a ship by connecting it to a facility, such as an LNG terminal, or an LNG supply tanker situated at a dock.

It should also be noted that an arrangement of this type permits easy handling of the suspended ducts, whereas the ducts have a relatively heavy weight because they are already filled with liquid natural gas during the maneuvering, and/or they support heavy elements, such as emergency disconnection devices, for example.

Depending on the embodiments, a transfer system of this type can comprise one or more of the following characteristics:

- the rigidification element is a rigid sheath which is fitted such as to slide along the duct, between the elongate rigidification position, in which the rigid sheath envelops the flexible portion, and the retracted position of release, in which the rigid sheath envelops the rigid portion;
- the rigidification element is a rigid rod, which is fitted such as to slide on the first rigid portion, and has at least one hoop fitted such as to slide around the flexible portion;
- the rigidification element comprises a widened end. A widened end of this type makes it possible to facilitate the deployment of the rigidification element towards its elongate rigidification position;
- the widened end has a radius of curvature which is equal to, or greater than, the minimum radius of curvature of the flexible portion, in order to protect said flexible portion;
- the system comprises a device for actuation of the rigidification element, which can displace the rigidification element between its elongate rigidification position and its retracted position of release;
- the device for actuation of the rigidification element comprises a jack with a first end which is integral with the rigid portion, and a second end which is integral with the rigidification element;
- the device for actuation of the rigidification element comprises a threaded rod, which cooperates firstly with the rigid portion, via a pivot connection, and secondly with a threaded bore in an element which is integral with the rigidification element and a motor which rotates the threaded rod;

the device for actuation of the rigidification element is a cable hoisting device;

the duct is connected to the transfer line by means of a bent flexible connection;

the duct is connected to the transfer line by means of one or more revolving joints;

the duct is fitted on the mast by means of an articulation, which permits the movement of the duct between a retracted position, in which it extends along the mast, and a deployed position;

the system comprises a jack which is designed to displace the duct between its retracted position and its deployed position;

the duct is equipped with an emergency disconnection device;

the system comprises a plurality of fluid transfer lines which extend along the mast and a plurality of ducts, which are suspended at the distal end of the mast, each of said ducts comprising a first, rigid portion, a second, flexible portion, which extends successively from the fluid transfer line to the connection element, and a rigidification element which is fitted such as to be mobile along the duct, between an elongate position for rigidification of the flexible portion, and a retracted position of release;

the mast is a braced mast comprising uprights which are assembled by counterbracing cross-members, the uprights being hollow and forming the plurality of fluid transfer lines.

According to one embodiment, the invention also provides a ship equipped with a transfer system as previously described.

According to one embodiment, the invention also provides a method for transfer of a fluid between a ship as previously described and a client ship.

BRIEF DESCRIPTION OF THE FIGURES

The invention will be better understood, and other objectives, details and characteristics of it will become more apparent during the following description of a plurality of particular embodiments of the invention, provided purely by way of non-limiting illustration, with reference to the appended drawings.

DETAILED DESCRIPTION OF EMBODIMENTS

Figure 12:
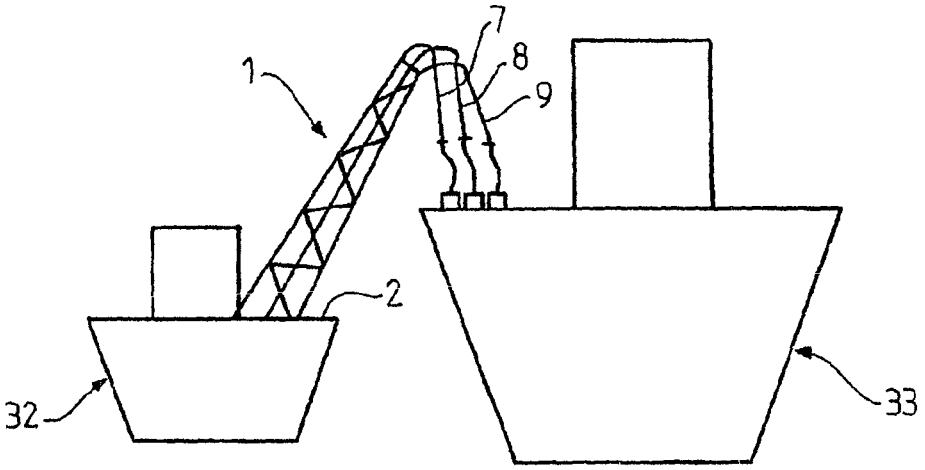
FIG. 12 illustrates schematically an operation of transfer between a bunker barge and a client ship.

A description will be provided hereinafter of a transfer system which makes it possible to transfer fluid, such as liquid natural gas (LNG) between a supplier ship 32 and a client ship 33, represented in FIG. 12. The supplier ship 32 is for example a bunker barge responsible for supplying other ships with LNG, and the client ship 33 is a ship which runs on LNG.

With reference to FIGS. 1 to 4, it can be seen that the transfer system comprises a braced mast 1 which is fitted on the deck 2 of the supplier ship 32.

The braced mast 1 comprises three uprights 3, 4, 5 which are assembled by a plurality of counterbracing cross-members 6 which extend between the uprights 3, 4, 5. The three uprights 3, 4, 5 are hollow, and thus form fluid transfer lines. A configuration of this type makes it possible to reduce the weight of the transfer system by using the fluid transfer lines as structural elements of the mast 1.

Two of the uprights 3, 4 are connected to a liquid natural gas storage tank of the supplier ship 32, and make it possible to transfer liquid natural gas from the supplier ship 32 to the client ship 33. The third upright 5 permits extraction of the natural gas in the gaseous state from the client ship 33 to the supplier ship 32. This third upright 5 is advantageously connected to a facility for re-liquefaction of the natural gas on board the supplier ship 32. In order to generate the pressure necessary for the transfer of the natural gas, there is implementation of the pumps on board the supplier ship 32 and/or of the pumps on board the client ship 33.

In another embodiment, a single upright 3 is connected to a liquid natural gas storage tank of the supplier ship 32, in order to transfer liquid natural gas from the supplier ship 32 to the client ship 33, and a single upright 4 permits the extraction of the natural gas in the gaseous state from the client ship 33 to the supplier ship 32. In this case, the third upright 5 can be used in particular to supply another fluid to the client ship, such as dinitrogen which permits inerting of the LNG transfer piping or another fuel such as diesel or fuel oil.

In another embodiment, when the liquid natural gas storage tank of the supplier ship 32 is a tank of type C, i.e. a cylindrical tank which makes it possible to store the natural gas under pressure, the liquid natural gas can be transferred to the client ship 33 by maintaining a pressure in the supplier ship 32 tank which is higher than that which exists in the client ship 33 tank. In this case, no pump is necessary for the transfer of the fluid. In addition, there is no need to provide for extraction of gas from the gaseous headspace of the client ship 33 to the supplier ship 32.

Each of the uprights 3, 4, 5 is connected to a duct 7, 8, 9 which is suspended at the distal end of the mast 1. At their free end, the ducts 7, 8, 9 comprise a connection element 10, which is designed to cooperate with a manifold of the client ship 33, in order to connect the supplier ship 32 to the client ship 33.

The mast 1 is fitted articulated on the deck 2 of the supplier ship 32, in order to direct the ducts 7, 8, 9 to the manifolds of the client ship 33. For this purpose, the mast 1 is firstly fitted such as to be mobile in rotation around a vertical axis, and is secondly fitted such as to pivot around a horizontal axis, between a retracted position represented in FIG. 1, and a raised position represented in FIGS. 2 to 4. For this purpose, the mast 1 is fitted on a rotary plate 11 which can rotate around a vertical axis. In addition, in order to permit the displacement of the mast 1 between its retracted position and its raised position, the transfer system is equipped with an actuation jack 12 comprising a first end which is fitted articulated on the rotary place 11, and a second end which is fitted articulated on a counterbracing cross-member 6 of the mast 1. In the embodiment represented, the mast 1 additionally comprises a ladder 13 which allows an operator to access its distal end.

Figure 5:
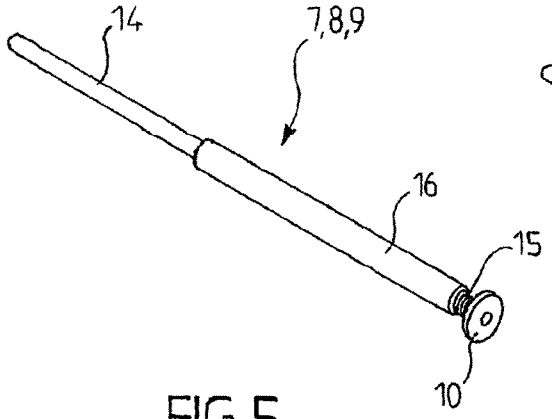
FIGS. 5 and 6 are detailed schematic views of a duct suspended at the end of the mast, in which the rigidification element is respectively in the elongate rigidification position, and in the retracted position of release.
Figure 6:
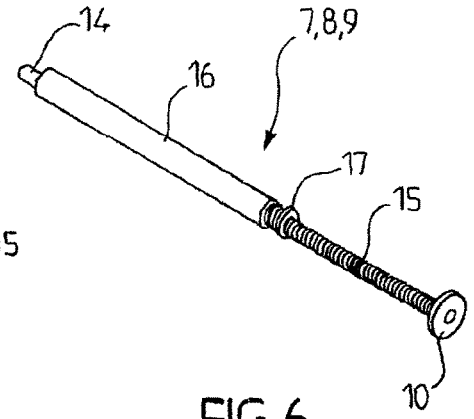

FIGS. 5 and 6 represent in a detailed manner the structure of the ducts 7, 8, 9 suspended at the distal end of the mast 1. The ducts 7, 8, 9 comprise in succession, starting from the uprights 3, 4, 5 of the mast 1 towards the connection element 10, a first, rigid portion 14 and a second, flexible portion 15. In addition, the ducts 7, 8, 9 are equipped with a mobile rigidification element. The rigidification element is in this case a rigid sheath 16 which is fitted such as to slide along the duct 7, 8, 9, between an elongate rigidification position represented in FIG. 5, and a retracted position of release represented in FIG. 6. The rigid sheath 16 slides along the flexible portion 15, between its retracted position and its elongate rigidification position.

By way of example, a rigid sheath 16 of this type can in particular be made of stainless steel, or any other material which can ensure sufficient rigidity.

In the elongate rigidification position illustrated in FIG. 5, the rigid sheath 16 envelops the flexible portion 15 and supports it as far as a distal area of the latter. The rigid sheath 16 thus limits the deformations of the duct 7, 8, 9. The flexible portion 15 is thus kept aligned in the extension of the rigid portion 14. In the retracted position of release, illustrated in FIG. 6, the rigid sheath 16 covers the rigid portion 14 of the duct 7, 8, 9, such that the flexible portion 15, which is then no longer enveloped in the rigid sheath 16, regains its freedom of flexion under the effect of gravity. In other words, by displacing the rigid sheath 16 from its elongate rigidification position to its retracted position of release, a length of the flexible portion 15 is released, in order to permit flexion of said flexible portion 15 along the free length.

An arrangement of this type makes it possible to facilitate the connection maneuvers. In fact, during maneuvers of approach of the ducts 7, 8, 9 to the client ship 33, the rigidification elements are positioned in the elongate rigidification position. Also, the flexible portion 15 is supported by the rigidification element. In addition, the ducts 7, 8, 9 are rigid along substantially their entire length, and are therefore not subjected to significant and unforeseeable deformations, such that grasping and handling of them by operators is facilitated. Subsequently, when the ducts 7, 8, 9 have been positioned in the vicinity of the manifolds of the client ship 33 with which they are designed to be connected, the rigidification elements are then displaced to their retracted position of release, such as to permit the association of the connection element 10 with the manifold of the client ship 33. During the transfer of the liquid natural gas, the rigidification elements remain in the retracted position of release, such that, by means of their flexible portion 15, the ducts 7, 8, 9 have flexibility which permits the relative movements between the client ship 33 and the supplier ship 32.

The rigid portion 14 and the flexible portion 15 of the ducts 7, 8, 9 are advantageously constituted by cryogenic pipes, such as double-wall stainless steel pipes, the intermediate space of which is lined with an insulating material. In one embodiment, the insulating material is put under partial vacuum in order to improve its insulation characteristics. In addition, the inner and outer walls of the flexible portion 15 have undulations which ensure the flexibility of the flexible portion 15.

In the embodiment represented in FIG. 6, the ducts 7, 8, 9 are equipped with an emergency disconnection device 17, which makes it possible to disconnect and interrupt the transfer of the liquid natural gas. An emergency disconnection device of this type is commonly designated by the term ERC (Emergency Release Coupling). In this case, the emergency disconnection device 17 is positioned between the rigid portion 14 and the flexible portion 15. In another embodiment, not represented, the emergency disconnection device 17 is positioned at the free end of the flexible portion 15, and constitutes the element 10 of connection with the manifold of the client ship 33.

Figure 13:
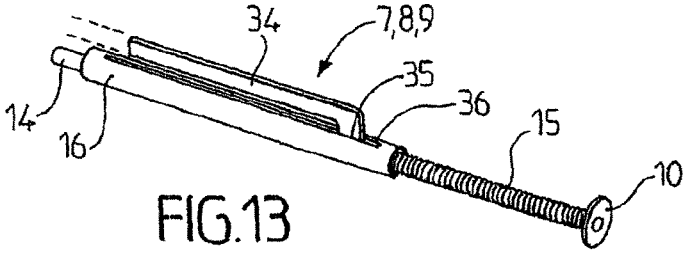
FIG. 13 is a detailed schematic view of a duct suspended at the end of the mast, according to an embodiment wherein the rigid portion of the duct is equipped with a rigidifier.

In an embodiment represented in FIG. 13, the suspended duct 7, 8, 9 additionally comprises an external rigidifier 34. The external rigidifier 34 comprises a rod which extends along the rigid portion 14, and has a first end 35 secured on the rigid portion 14, in the vicinity of its area of connection with the flexible portion 15, and a second end, not represented, secured on the distal end of the mast 1. In this case, the rigid sheath 16 is equipped with a longitudinal groove 36, which permits securing of the rod on the rigid portion 14 by means of the rigid sheath 16. A rigidifier 34 of this type makes it possible to reinforce the rigidity of the rigid portion 14 further. In fact, it is necessary for the rigid portion 14 to retain its straight nature in order not to impede the movement of the rigidification element towards its retracted position. In another embodiment, it is also possible to equip the rigid sheath 16 with a telescopic external rigidifier, one end of which would be secured on the rigid sheath 16 and a second end secured on the distal end of the mast 1.

Figure 14:
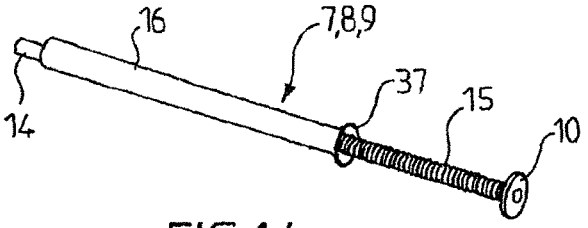
FIG. 14 is a detailed schematic view of the duct suspended at the end of the mast, according to an embodiment wherein the rigidification element comprises a widened end.

In addition, in an embodiment represented in FIG. 14, the rigidification element, which in this case is the rigid sheath 16, comprises on its free end a widened portion 37. A widened portion 37 of this type makes it possible to facilitate the deployment of the rigidification element towards its elongate rigidification position. The widened portion 36 advantageously comprises a radius of curvature which is equal to, or greater than, the minimum radius of curvature of the flexible portion 15, in order to protect said flexible portion 15 against excessive bending. In addition, the end of the widened portion 37 has a perimeter which is substantially the same as that of the connection element 10, such that the widened portion contributes to the support of the connection element 10 when the transfer system is in the storage position, and the rigid sheath 16 is in its elongate rigidification position.

Figure 11:
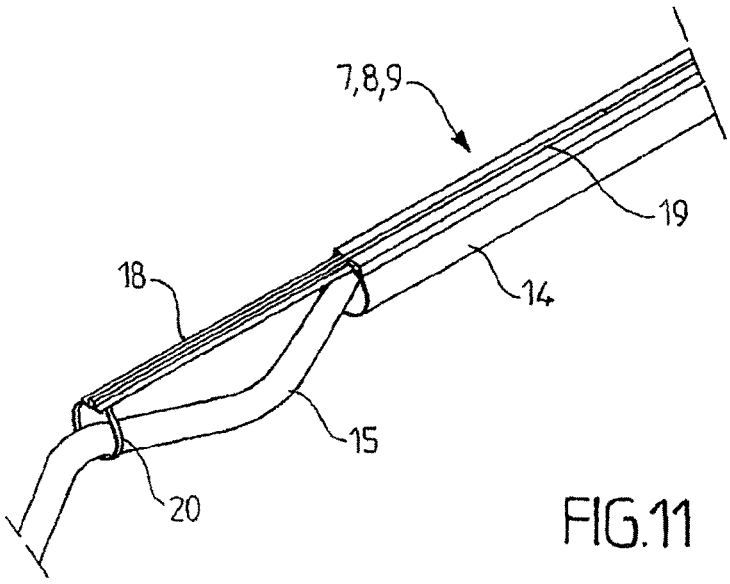
FIG. 11 illustrates a rigidification element according to another embodiment.

In the embodiment represented in FIG. 11, the rigidification element consists of a rigid rod 18, which is fitted such as to slide in a slide 19 supported by the rigid portion 14. The rigid rod 18 supports one or a plurality of hoops 20 which are fitted such as to slide around the flexible portion 15, and thus ensure a connection between the rigid rod 18 and the flexible portion 15. The rigid rod 18 is fitted such as to slide along the flexible portion 15, between a rigidification position, in which it extends along the flexible portion 15, such as to align the flexible portion in the extension of the rigid portion 14, and a retracted position of release, in which the rigid rod 18 is retracted inside the slide 19, and no longer supports the flexible portion 15.

In other embodiments, not illustrated, the rigidification element is a telescopic element, for example a telescopic sheath. An embodiment of this type makes it possible in particular to provide ducts 7, 8, 9, the length of the flexible portion 15 of which is longer than the length of the rigid portion 14.

Figure 1:
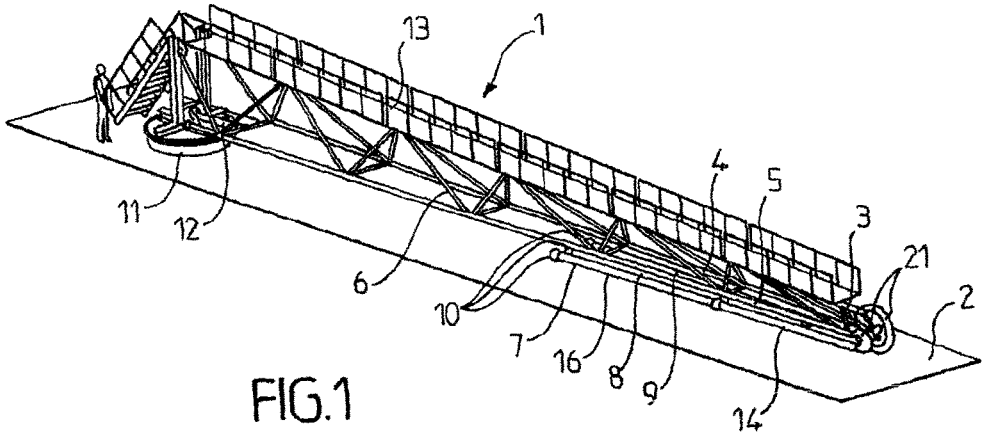
FIGS. 1 to 4 are schematic views in perspective of a fluid transfer system, illustrating the steps of maneuvering of the transfer system for connection of the ship to a facility.
Figure 2:
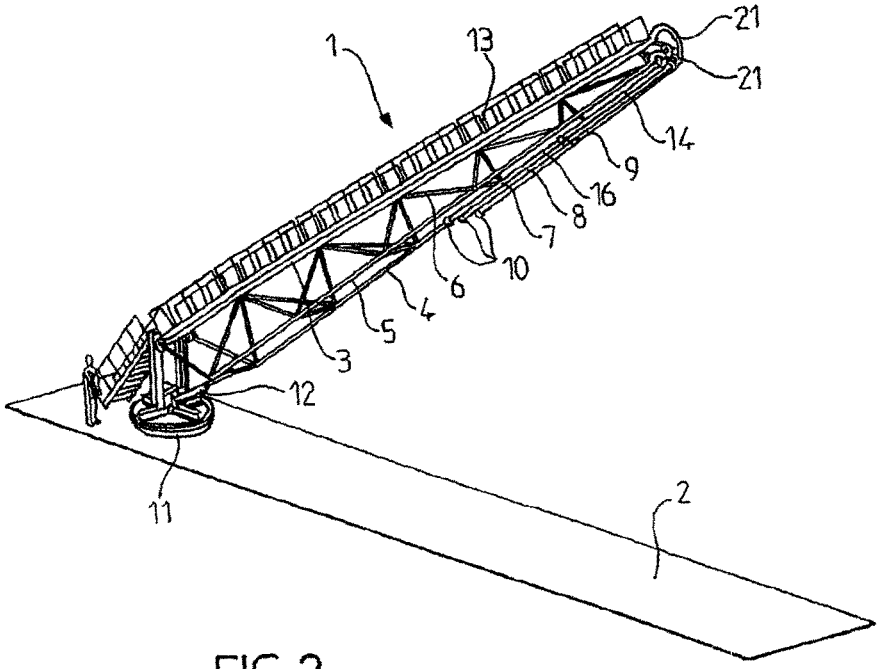
Figure 3:
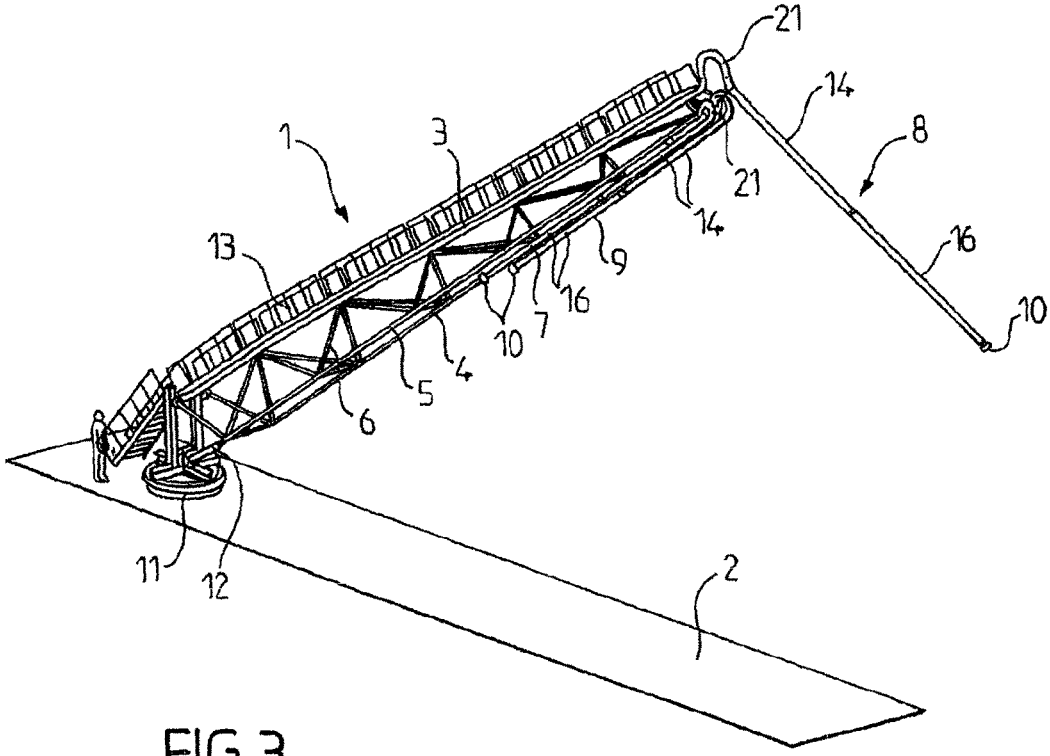
Figure 4:
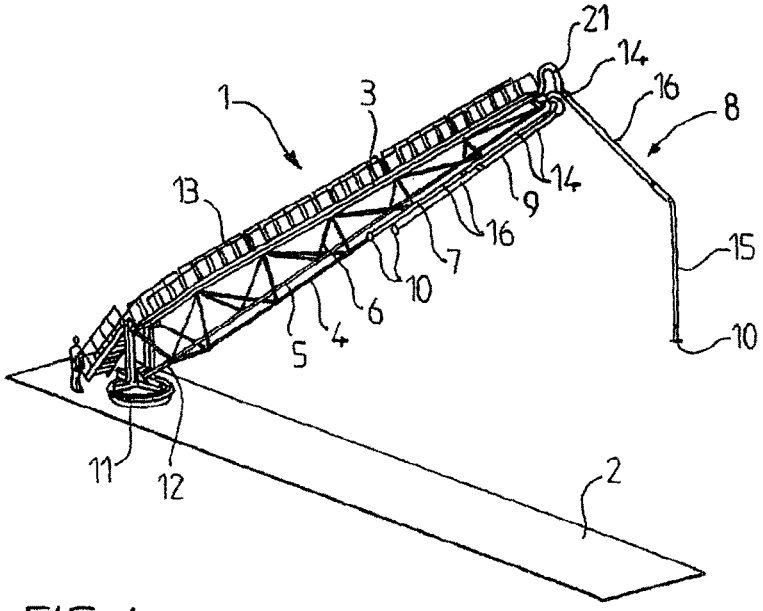
Figure 7:
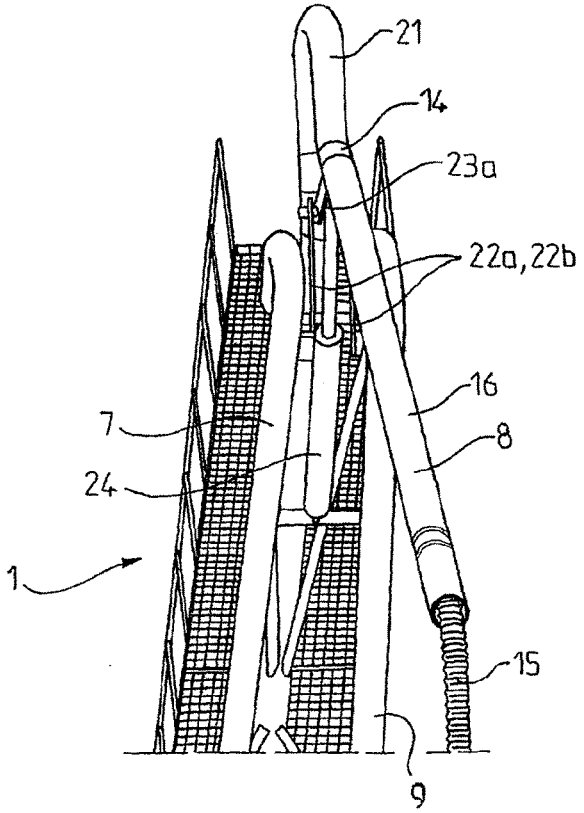
FIG. 7 illustrates in a detailed manner the articulation of a duct at the end of the mast.

In addition, it can be seen in FIGS. 1 to 4 that the ducts 7, 8, 9 are each connected to the uprights 3, 4, 5 of the mast 1 by means of a flexible bent duct 21. In addition, the ducts 7, 8, 9 are fitted articulated on the end of the mast 1, between a retracted storage position, in which they extend substantially along the mast 1, and a position deployed in the direction of the client ship 33. FIGS. 3, 4 and 7 illustrate two ducts 7, 9 in a retracted storage position, whereas one duct 8 is in a deployed position. FIG. 7 illustrates in a detailed manner an articulation of a duct 8 relative to the mast 1. The articulation is composed of two sets of two connecting rods 22*a*, 22*b*, 23*a*, 23*b*, which extend on both sides of each duct 7, 8, 9. Each set of connecting rods comprises a first connecting rod 22*a*, 22*b* with an end which is secured on the mast 1, and a second connecting rod 23*a*, 23*b* comprising an end which is secured on the rigid portion 14 of the duct 7, 8, 9. In addition, the first connecting rod 22*a*, 22*b* and the second connecting rod 23*a*, 23*b* of each set are articulated on one another around an axis of articulation. In addition, for each duct 7, 8, 9, the system comprises an actuation jack 24, which comprises a first end fitted articulated on an end of the mast 1, and a second end fitted articulated on the second connecting rods 23*a*, 23*b* or on the rigid portion 14 of the duct 7, 8, 9.

An articulation of this type of the ducts 7, 8, 9 on the mast 1 makes it possible firstly to facilitate the maneuvering of the ducts 7, 8, 9, and secondly to reduce their size on the supplier ship 32, when they are positioned in their retracted storage position.

Figure 15:
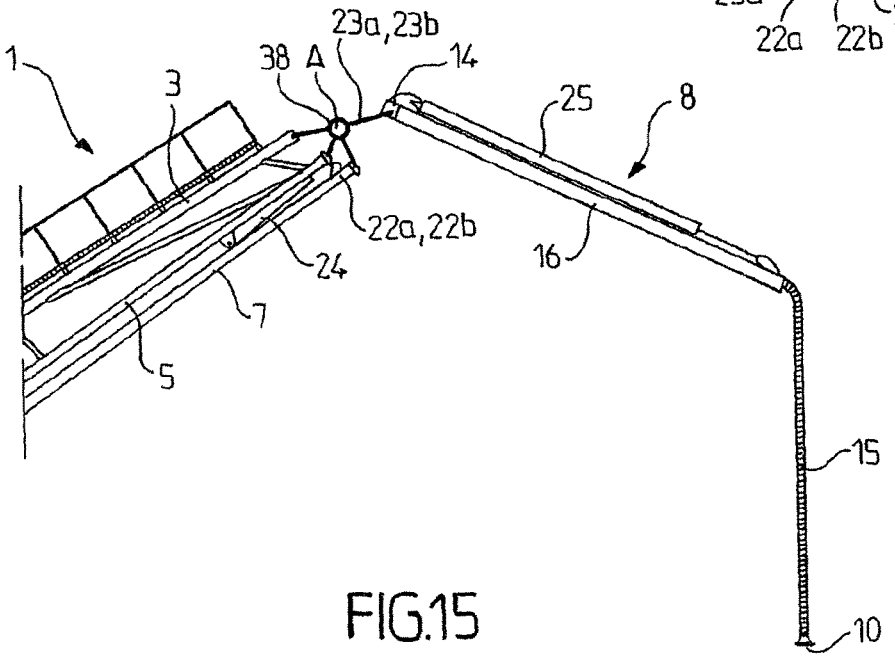
FIG. 15 illustrates an embodiment wherein a duct is connected to a transfer line by means of a revolving joint.

In another embodiment, represented in FIG. 15, the ducts 7, 8, 9 are each connected to the uprights 3, 4, 5 of the mast 1 by means of a revolving joint 38 which is also known as a revolving connection. A revolving joint of this type ensures a connection in rotation, without leakage, between a fixed upright 3, 4, 5 and the duct 7, 8, 9 which is suspended on the mast 1, and is mobile relative to said upright 3, 4, 5. The revolving joint 38 has an axis of rotation A which is horizontal. When the transfer system comprises only one revolving joint 38, its axis A is coaxial with the axis of articulation of the duct 8 relative to the mat 1, i.e. in the embodiment represented, the axis of articulation between the first connecting rods 22*a*, 22*b* and the second connecting rods 23*a*, 23*b*.

Figure 16:
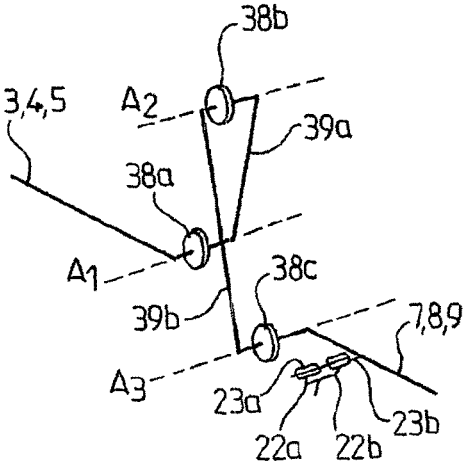
FIG. 16 illustrates schematically an embodiment wherein a duct is connected to a transfer line by means of three revolving joints.

In the embodiment represented schematically in FIG. 16, the ducts 7, 8, 9 are each connected to the uprights 3, 4, 5 of the mast 1 by means of three revolving joints 38*a*, 38*b*, 38*c* with axes of articulation A1, A2, A3 which are parallel and horizontal. The revolving joints 38*a*, 38*b*, 38*c* are connected by rigid tubes 39*a*, 39*b*. By means of an arrangement of this type of revolving joints, it is not necessary for one of the axes of articulation A1, A2, A3 of the revolving joints 38*a*, 38*b*, 38*c* to be aligned with the axis of articulation of the duct 7, 8, 9 relative to the mast 1.

Figure 8:
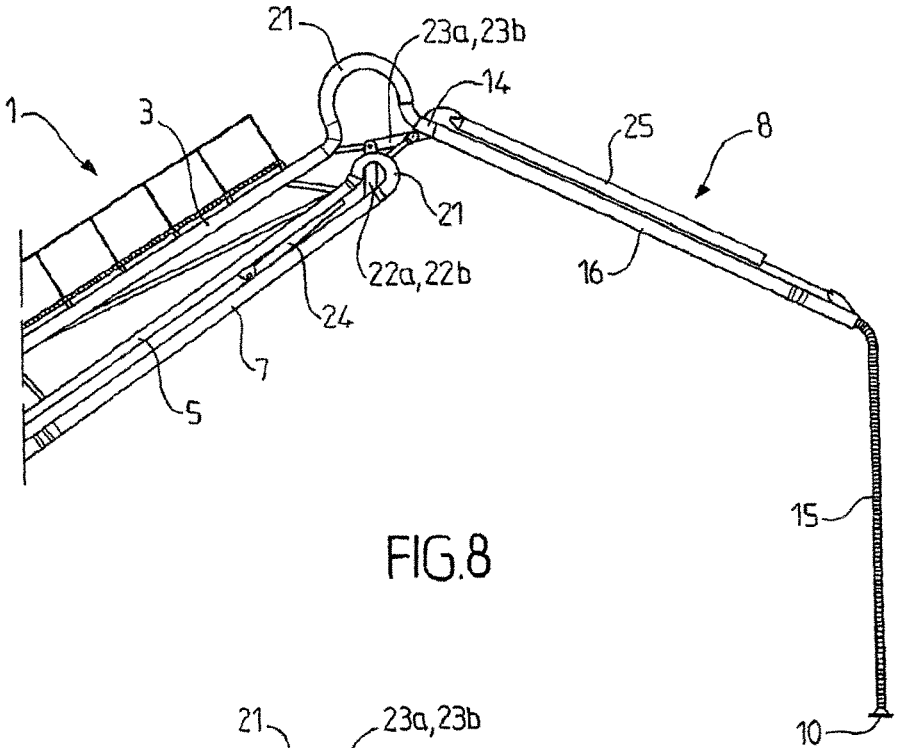
FIGS. 8, 9 and 10 illustrate transfer systems equipped with actuation devices which can permit the displacement of the rigidification element according to three variant embodiments.
Figure 9:
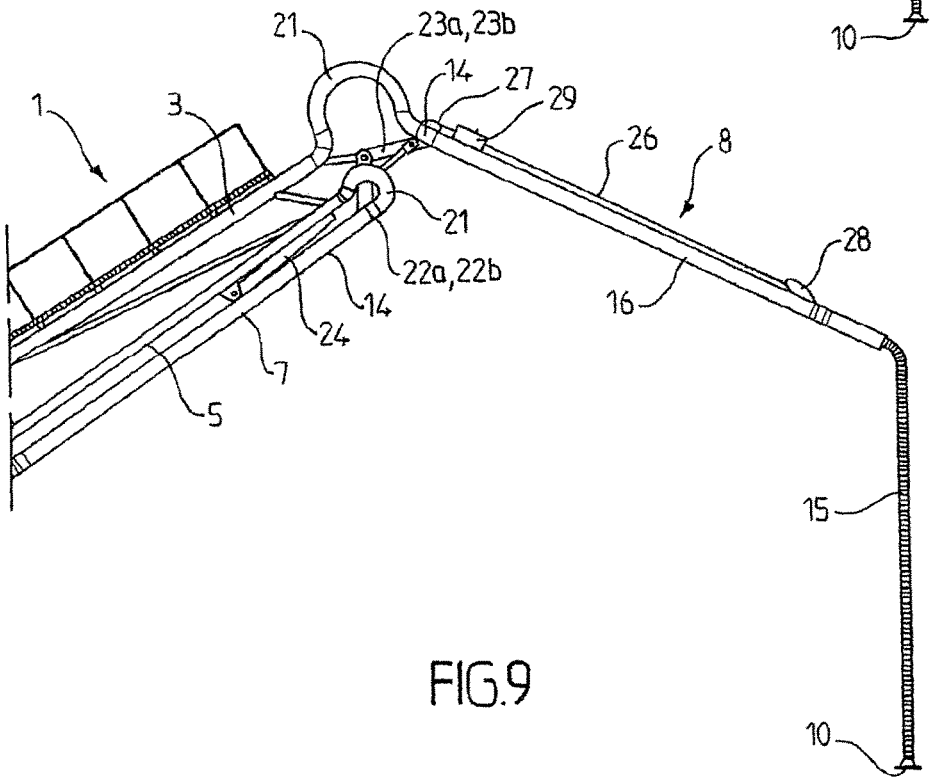
Figure 10:
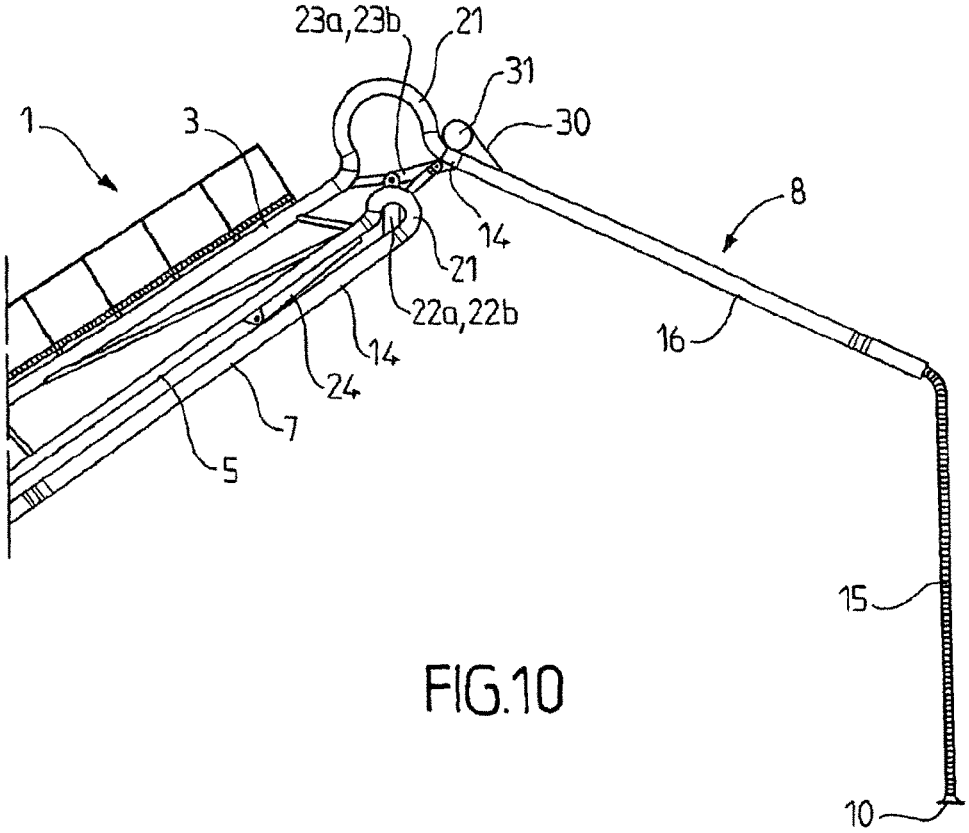

FIGS. 8, 9 and 10 illustrate variant embodiments of actuation devices which can displace a rigidification element, such as a rigid sheath 16, between its rigidification position and its position of release.

In the embodiment illustrated in FIG. 8, the actuation device comprises a jack 25, one end of which is secured on the rigid portion 14 and the other end is fitted on the rigid sheath 16.

In the embodiment represented in FIG. 9, the actuation device comprises a threaded rod 26, which cooperates firstly with a first element 27 in pivot, non-sliding connection with the rod 26, and integral with the rigid portion 14, and secondly with a second element 28, in pivot, non-sliding connection with the rod 26, and integral with the rigid portion 14. A groove in the sheath 16 allows the element 28 to be secured on the rigid portion 14 by means of the sheath 16. A motor, not represented, secured on the rigid portion 24, makes it possible to rotate the threaded rod 26. The element 29 is integral with the sheath 16, and has a threaded bore which makes it possible to transform the rotation of the threaded rod into translation of the sheath 16.

In the embodiment represented in FIG. 10, the actuation device is a cable hoisting device. In this case, the actuation device comprises a winch 31 which is supported by the rigid portion 14, and comprises a cylinder around which a cable 30 is wound. The winch 1 comprises a motor which makes it possible to rotate the cylinder in order to wind the cable 30. One of the ends of the cable 30 is secured on the rigidification element. Thus, the winch 31 makes it possible to raise the rigidification element to its position of release.

In another embodiment, not represented, it is also possible to position the winch in the vicinity of the base of the mast 1, and to use a return pulley which is supported by the rigid portion 14 of the duct 7, 8, 9. In another embodiment, it is also possible to use a block and tackle transmission mechanism comprising a pulley which is supported by the flexible portion 14 of the duct 7, 8, 9, and a second pulley which is supported by the rigidification element.

It should be noted that, when cable systems of this type are used as a device for actuation of the rigidification element, the rigidification element can return to its rigid position under the effect of its weight.

Although the invention has been described in association with a plurality of particular embodiments, it is apparent that it is in no way limited to these, and that it comprises all the technical equivalents of the means described as well as their combinations, if these come within the scope of the invention.

Use of the verbs "contain", "comprise" or "include" and their conjugated forms does not exclude the presence of other elements, or steps other than those described in a claim. Use of the indefinite article "a" or "an" for an element or a step does not exclude the presence of a plurality of such elements or steps, unless otherwise stated.

In the claims, any reference number in brackets cannot be interpreted as a limitation of the claim.

The invention claimed is:

1. A system for transfer of a fluid between a ship and a facility comprising:

a mast comprising a proximal end which is designed to be fitted articulated on a platform of the ship, and a distal end;

at least one fluid transfer line which extends along the mast; and at least one duct suspended on the distal end of the mast, which is firstly connected to the fluid transfer line, and secondly equipped with a connection element which is designed to cooperate with a manifold of the facility;

wherein the duct comprises:

a first, rigid portion and a second, flexible portion, which extend successively from the fluid transfer line to the connection element; and a rigidification element which is fitted such as to be mobile along the duct, between an elongate position for rigidification of the flexible portion, in which the rigidification element extends along the flexible portion, and a retracted position of release, in which the rigidification element extends along the rigid portion, the rigidification element comprising a support which can slide relative to the flexible portion, along the flexible portion, the support cooperating with a distal end of the flexible portion in the elongate position of the rigidification element, in order to align the flexible portion in the extension of the rigid portion, and the support cooperating with an area of the duct, situated between the distal area of the flexible portion and the distal end of the mast, in the retracted position of release of the rigidification element, such as to release said support along a free length of the flexible portion, in order to permit flexion of the flexible portion along the free length, wherein the duct is fitted on the mast by means of an articulation, which permits the movement of the duct between a retracted position, in which it extends along the mast, and a deployed position.

2. The system as claimed in claim 1, characterized in that the rigidification element is a rigid sheath which is fitted such as to slide along the duct, between the elongate rigidification position, in which the rigid sheath envelops the flexible portion, and the retracted position of release, in which the rigid sheath envelops the rigid portion.

3. The system as claimed in claim 1, wherein the rigidification element is a rigid rod, which is fitted such as to slide on the first rigid portion, and has at least one hoop fitted such as to slide around the flexible portion.

4. The system as claimed in claim 1, wherein the rigidification element comprises a widened end.

5. The system as claimed in claim 1, comprising a device for actuation of the rigidification element, which can displace the rigidification element between its elongate rigidification position and its retracted position of release.

6. The system as claimed in claim 5, wherein the device for actuation of the rigidification element comprises a jack with a first end which is integral with the rigid portion, and a second end which is integral with the rigidification element.

7. The system as claimed in claim 5, wherein the device for actuation of the rigidification element comprises a threaded rod, which cooperates firstly with the rigid portion, via a pivot connection, and secondly with a threaded bore in an element which is integral with the rigidification element and a motor which rotates the threaded rod.

8. The system as claimed in claim 5, wherein the device for actuation of the rigidification element is a cable hoisting device.

9. The system as claimed in claim 1, wherein the duct is connected to the transfer line by means of a bent flexible connection.

10. The system as claimed in claim 1, wherein the duct is connected to the transfer line by means of at least one revolving joint.

11. The system as claimed in claim 1, comprising a jack which is designed to displace the duct between its retracted position and its deployed position.

12. The system as claimed in claim 1, wherein the duct is equipped with an emergency disconnection device.

13. The system as claimed in claim 1, comprising a plurality of fluid transfer lines which extend along the mast and a plurality of ducts, which are suspended at the distal end of the mast, each of said ducts being connected to one of the fluid transfer lines and comprising a connection element which is designed to cooperate with a manifold of the facility, a first, rigid portion, a second, flexible portion, which extends successively from said fluid transfer line to said connection element, and a rigidification element which is fitted such as to be mobile along the duct, between an elongate position for rigidification of the flexible portion, and a retracted position of release.

14. The system as claimed in claim 13, wherein the mast is a braced mast comprising uprights which are assembled by counterbracing cross-members, and in that the uprights are hollow and form the plurality of fluid transfer lines.

15. A ship equipped with a transfer system according to claim 1.

16. A method for transfer of a fluid between the ship as claimed in claim 15 and a client ship, comprising the steps of:

providing the ship as claimed in claim 15;

providing the client ship; and transferring the fluid through the fluid transfer line and the duct of the ship.

* * * * *